US008658876B2

(12) United States Patent
Momose

(10) Patent No.: US 8,658,876 B2
(45) Date of Patent: Feb. 25, 2014

(54) MUSICAL INSTRUMENT CARRIER AND RELATED METHODS

(75) Inventor: Katsuhiro Momose, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 199 days.

(21) Appl. No.: 13/305,068

(22) Filed: Nov. 28, 2011

(65) Prior Publication Data

US 2013/0133505 A1 May 30, 2013

(51) Int. Cl.
*G10D 13/02* (2006.01)

(52) U.S. Cl.
USPC ..... 84/421

(58) Field of Classification Search
USPC ..... 84/421
See application file for complete search history.

(56) References Cited

U.S. PATENT DOCUMENTS 909,217 A * 1/1909 Presba et al. ..... 224/201
4,715,293 A * 12/1987 Cobbs ..... 108/43
6,028,257 A * 2/2000 May ..... 84/421
6,329,583 B1 12/2001 May
6,765,140 B2 7/2004 Crouch
7,795,518 B2 9/2010 Yoshino et al.
2004/0159211 A1 8/2004 Crouch
2006/0081115 A1 4/2006 Shimada
2008/0202316 A1 8/2008 Hsieh
2010/0154617 A1* 6/2010 May ..... 84/421

* cited by examiner

*Primary Examiner* — Christopher Uhlir
(74) *Attorney, Agent, or Firm* — Berenato & White, LLC

(57) ABSTRACT

A body-supportable musical-instrument carrier, comprises a rigid frame substantially conforming to shoulder and upper back regions of a user; a belly plate; first mounting members mountable on the belly plate for securing the belly plate to the rigid frame; and second mounting members mountable on the belly plate for securing the musical instrument to the body-supportable musical-instrument carrier. The second mounting members are a pair of J-rods having a first end portion mounted to the belly plate and a second end portion defined by a compound bend. In other words, the first ends of each J-rod lies in a different plane than the plane of the second ends. Additionally, the J-rods have a broader contact area against the drum for better stability compared to traditional support rods.

16 Claims, 14 Drawing Sheets

MUSICAL INSTRUMENT CARRIER AND RELATED METHODS

FIELD OF THE INVENTION

The present invention relates to body-supportable musical instrument carriers, especially to carriers wearable by a marching band member to support one or more percussion instruments, such as drums, and to permit the marching band member to simultaneously ambulate and play the percussion instrument(s). The present invention specifically relates to an improved J-rod assembly for the body-supportable musical instrument carriers.

BACKGROUND OF THE INVENTION

Musical instrument carriers are often necessary or at least desirable to permit a musician to play his or her musical instrument while standing, walking, and/or marching. Musical instrument carriers are especially useful for percussion instruments, such as drums and the like. Functionally, musical instrument carriers are optimally designed to provide comfort and mobility to the user and stability to the musical instrument while retaining the musical instrument in a convenient playing position, typically with both of the user's hands free and unobstructed to play the musical instrument. Further, it is important to note that the range of motion of the user's legs should be maximized for standing, marching and/or walking.

SUMMARY OF THE INVENTION

A body-supportable musical-instrument carrier, comprises a rigid frame substantially conforming to shoulder and upper back regions of a user for resting on the shoulder regions and extending across the upper back region of the user in use, the rigid frame further resting in front of a front torso region of the user in use; a belly plate; first mounting members mountable on the belly plate and engageable with the rigid frame for securing the belly plate to the rigid frame; and second mounting members mountable on the belly plate and engageable with a musical instrument for securing the musical instrument to the body-supportable musical-instrument carrier, wherein the second mounting members are a pair of J-rods having a first end portion mounted to the belly plate and a second end portion defined by a compound bend such that the second end portions of each of the rods have a lowest vertical end section extending away from one another. In other words, the first ends of each J-rod lies in a different plane than the plane of the second ends.

With the shape of the J-rod of the present invention, the linear axis defined by the first ends does not intersect with the linear axis defined by the second ends.

Each of the pair of J-rods is formed with said first end portion extending along the belly plate, with a transitional portion extending at an angle with respect to the first end portion, and with the compound bend at the second end portion. While the conventional J-rod lies in a single plane, the J-rod according to the present invention lies in more than one plane to provide the benefits that will be described below. For example, the compound bend provided on each of the J-rods according to the present invention provides additional leg room for the users when walking or marching without moving the position of the instrument relative to the harness or the user's torso.

Additional aspects of the invention, including apparatus, devices, carriers, systems, kits, combinations, sub-assemblies, and methods of making and using the same, will become apparent upon viewing the accompanying drawings and reading the detailed description below.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In such drawings.

Figure 2:
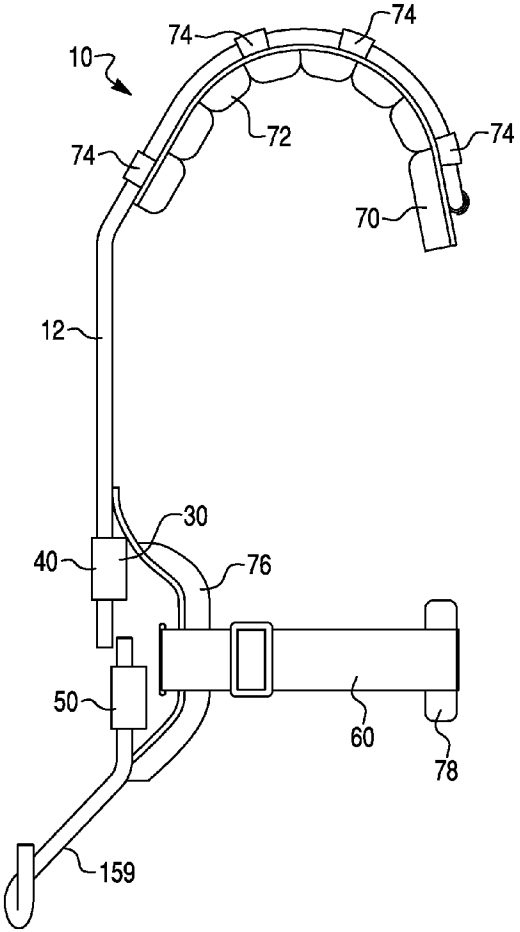
FIG. 2 is a side elevational view of the body-supportable musical-instrument carrier of FIG. 1.

DETAILED DESCRIPTION OF EXEMPLARY EMBODIMENTS AND EXEMPLARY METHODS OF THE INVENTION

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the exemplary embodiments and methods.

Figure 1:
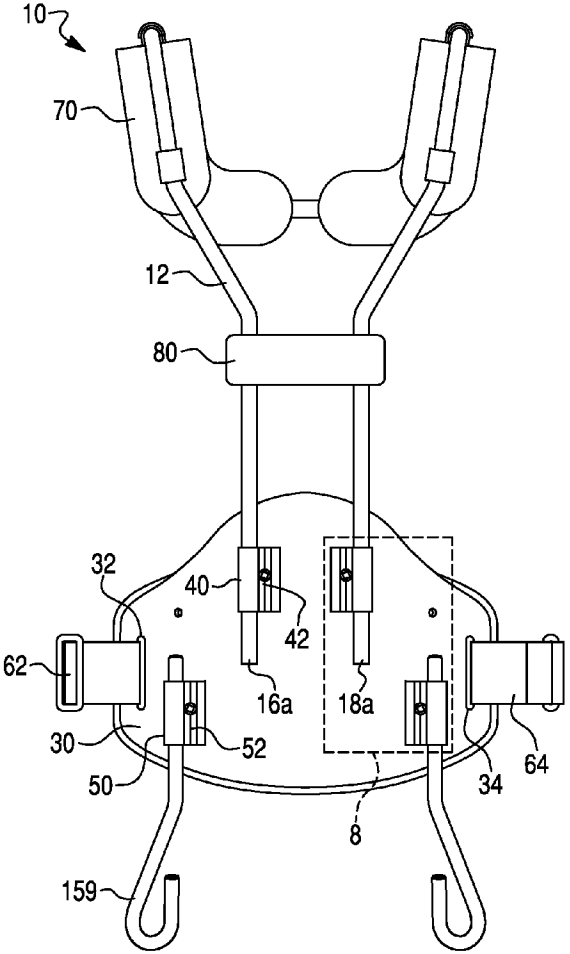
FIG. 1 is a front elevational view of a body-supportable musical-instrument carrier according to a first embodiment of the invention.
Figure 4:
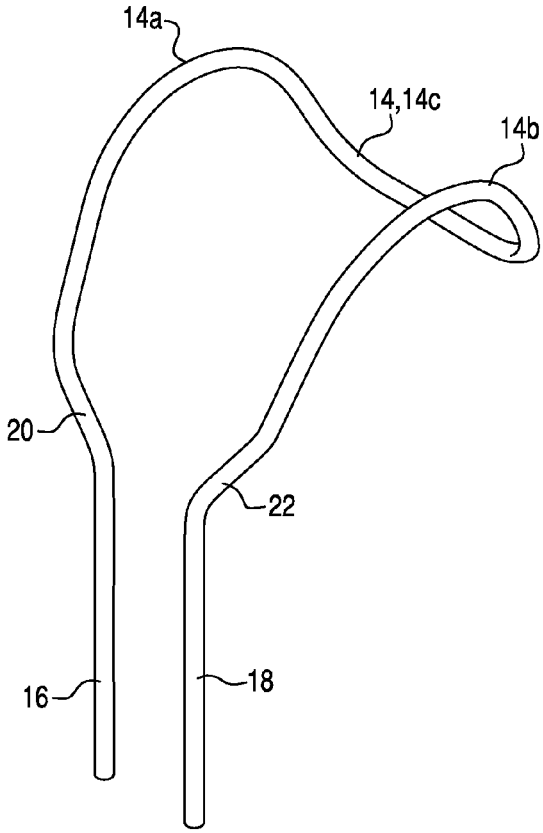
FIG. 4 is a perspective view of a rigid tubular frame of the body-supportable musical-instrument carrier of FIGS. 1 and 2.

A body-supportable musical-instrument carrier is generally designated by reference numeral 10 in FIGS. 1 and 2. The musical instrument carrier 10 includes a rigid tubular frame 12 that is symmetrical. As best shown in FIG. 4, the frame 12 has an intermediate section 14 configured along its length to establish a substantially U-shape in plan view. The substantially U-shaped intermediate section 14 is formed, bent, or otherwise configured to substantially conform in shape over both shoulder regions and across the upper back (optionally including the neck) region of an intended user/wearer of the musical instrument carrier 10. When the musical-instrument carrier 10 is properly worn as intended, arcuate shoulder support areas 14*a*, 14*b* of the substantially U-shaped intermediate section 14 rest on the shoulder regions of the user, and a back or rear area 14*c* of the intermediate section 14 extends across and optionally rests on the upper back (optionally including the neck) region of the user. The opposite ends of the substantially U-shaped intermediate section 14 are angled around the chest area to establish inwardly flared sections 20, 22.

The rigid tubular frame 12 further includes first and second end sections 16, 18 extending substantially parallel relative to one another downward from opposite ends of the substantially U-shaped intermediate section 14, more specifically from the inwardly flared sections 20 and 22, respectively. When the musical-instrument carrier 10 is properly worn by the user, the first and second end sections 16, 18 extend downward in front of a front torso and abdominal region of the user, with the terminal ends 16*a*, 18*a* of the end sections 16, 18 facing the ground.

The rigid tubular frame 12 extends continuously from the terminal end of the first end section 16 to the terminal end of the second end section 18, The rigid tubular frame 12 may have a substantially uniform or varying cross-sectional area and cross-sectional shape over its continuous length. The cross-sectional shape of the rigid tubular frame 12 may be, for example, circular, oval, or polygonal, e.g., rectangular. The rigid tubular frame 12 may be a monolithic member, that is, a unitary singular piece. Alternatively, the rigid tubular frame 12 may comprise a plurality of segments or pieces connectable in end-to-end fashion to form the continuous structure. This segmented embodiment is particularly desirable for enhancing the storability and transportability of the rigid tubular frame 12. The end-to-end connections of this alternative segmented embodiment may be removable (non-permanent), such as segments with telescopic end portions connected to one another via quick-release pins, bolts, force-fitting, clamps, etc. Alternatively, the end-to-end connections may be made permanent, such as by welding.

Making the rigid tubular frame 12 of a light weight material, such as a metal or composite material, desirably reduces the load on the user. Aluminum is an example of a metal that may be extruded, bent, or otherwise formed into the rigid tubular frame 12. A combination of different materials may be selected. The weight of the rigid tubular frame 12 may be reduced by forming the tubular frame 12 as a hollow construction. Each of the end section 16, 18 may be equipped with an end fitting (not shown) to cover and conceal sharp edges of the ends 16*a*, 18*a* of the tubular frame 12 for safety. Alternatively, the rigid tubular frame 12 may be filled with filler. Alternatively, the rigid tubular frame 12 may replaced with a solid non-hollow rod that, except for being non-hollow, may be shaped and have the features described herein with respect to tubular frame 12.

Figure 5:
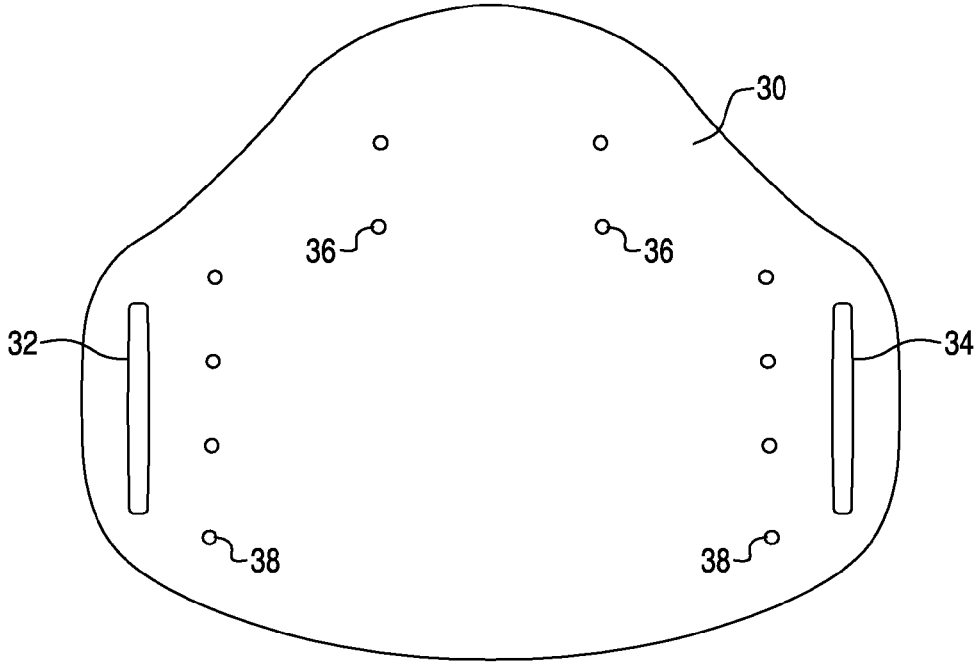
FIG. 5 is an enlarged, front elevational view of the belly plate of the body-supportable musical instrument carrier of FIGS. 1 and 2.

The musical-instrument carrier 10 further includes a belly plate 30. As best shown in FIG. 5. In the illustrated embodiment the belly plate 30 has a substantially pentagonal shape when viewed in plan. It should be understood that the belly plate 30 may be configured to have alternative shapes, such as a rectangle with sharp or rounded comers, an oval, etc. The belly plate 30 also is preferably made of a relatively light weight material, such as a metal or composite material.

Figure 6:
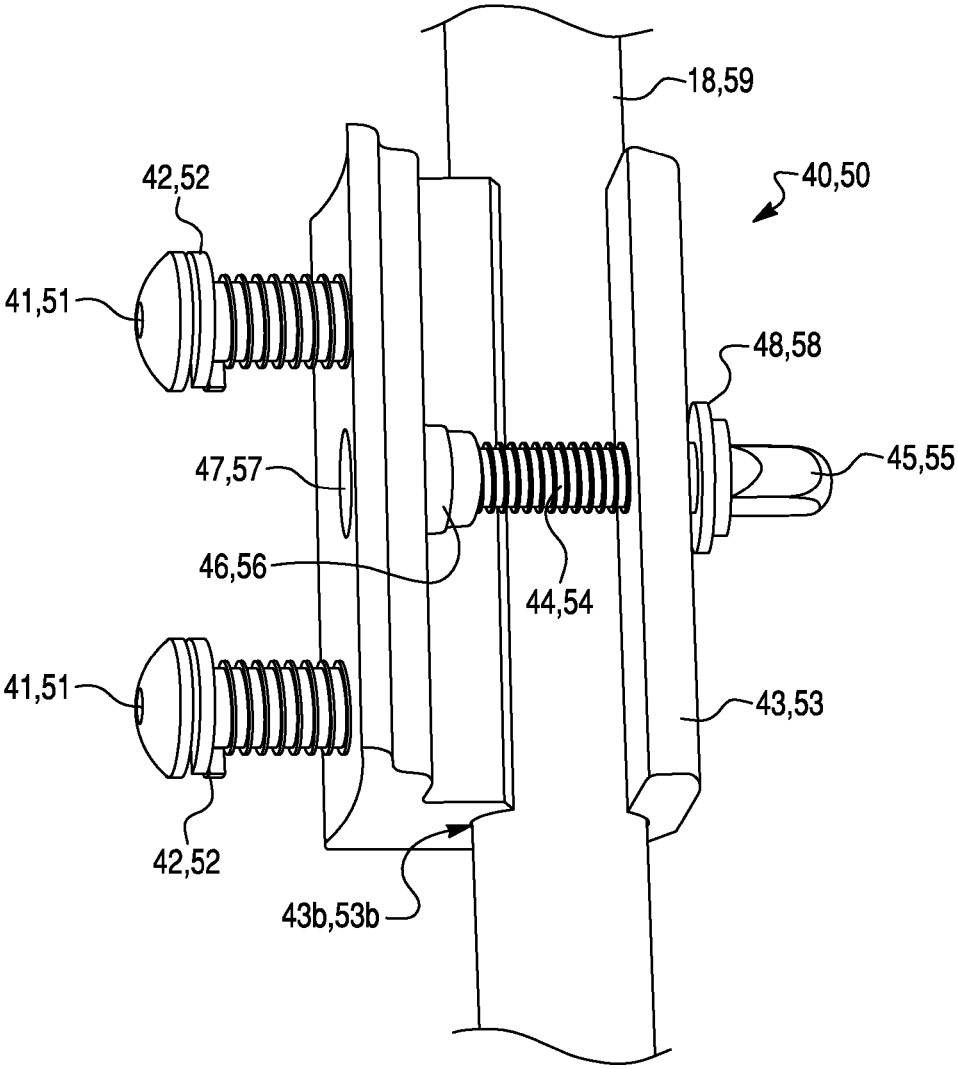
FIG. 6 is a disassembled, fragmented side view of mounting members of the body-supportable music instrument carrier of FIGS. 1 and 2.

As best shown in FIG. 5, the belly plate 30 possesses belt-receiving slots 32, 34 adjacent its left and right side edges. First mounting apertures 36 are positioned symmetrically (relative to a vertical symmetrical axis of the belly plate 30) at identical heights to one another. The first mounting apertures 36 comprise a left column of circular holes on one side of the belly plate 30 and a right column of circular holes on the other side of the belly plate 30. Second mounting apertures 38 are likewise formed in and symmetrically positioned relative to one another. The second mounting apertures 38 comprise a left column of circular holes on one side of the belly plate 30 and a right column of circular holes on the other side of the belly plate. The first mounting apertures 36 are positioned above and inwardly (towards the vertical symmetrical axis of the belly plate 30) relative to the second mounting apertures 38. It should be understood, however, that the belly plate 30 may be provided with different arrangements and quantities of mounting apertures 36, 38. For example, left and right columns of multiple mounting apertures 36 and/or 38 may be provided as a single left mounting aperture and a single right mounting aperture. The columns of mounting apertures 36 and 38 facilitate height adjustment of the musical instrument on the carrier 10. Alternatively, apertures 36, 38 may be shaped as elongate slots for facilitating continuous height adjustment of the musical instrument, Each of the first mounting members 40 is mountable to the belly plate 30 by inserting the shafts of a pair of screws 41,51 through corresponding ones of the first mounting apertures 36. As best shown in FIG. 6, the shafts of the screws 41,51 carry lock washers 42, 52. The screw 41, 51 shafts are threadingly received in threaded holes (not shown) in the rear surface of a first receptacle body (also referred to as a bracket) 43, 53. Details of the preferred arrangement for the screws and lock washers may be found in U.S. Pat. No. 7,671,261, which is hereby incorporated by reference in its entirety.

Figure 7:
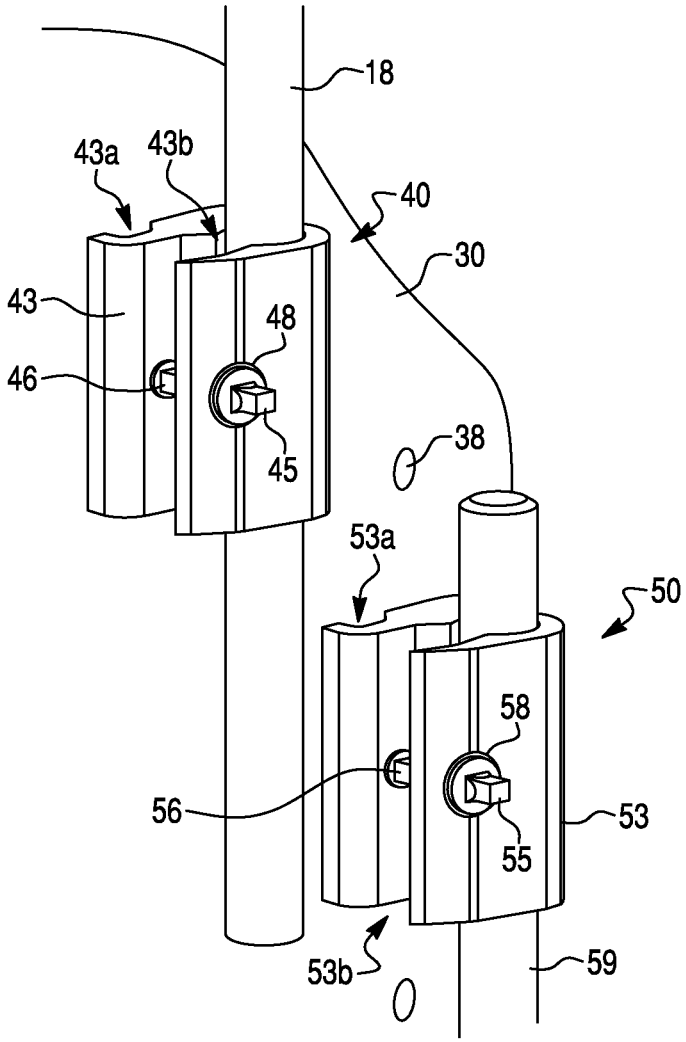
FIG. 7 is an enlarged fragmented perspective view of the body-supportable musical instrument carrier of FIGS. 1 and 2.

Each of first mounting members 40 further includes a first bolt 44 having a first square head 45, and a first nut 46. The first nut 46 is press-fitted into a rear arm of the first receptacle body (bracket) 43. As best shown in FIG. 7, which is an enlarged view of the area 8 of FIG. 1, the rear surface of the first receptacle body 43 may be provided with a shallow groove 43*a* for accommodating the rear end 47 of the first nut 46, i.e., so that any rearwardly protruding portion of the rear end 47 does not interfere with a flush interface between the rear surface of the first receptacle body 43 and the front surface of the belly plate 30. The first receptacle body 43 is mated with the first bolt 44 by inserting the shaft of the first bolt 44 through a front through hole (unnumbered) in a front arm of the first receptacle body 43. The front through hole is aligned with the first nut 46. A washer 48 may be carried on the first bolt 44 adjacent to the head 45. The shaft of the first bolt 44 is threadedly engaged with the first nut 46 and can be rotatably loosened and tightened using a suitable instrument, such as a key that mates with head 45.

The front and rear arms of each of the first receptacle bodies (brackets) 43 form a substantially vertically oriented open channel 43*b* that is configured and positioned to slidingly receive a respective end section 16, 18 of the rigid tubular frame 12. Tightening the first bolts 44 flexes the first receptacle body 43 into a clamping position, i.e., reducing the cross-sectional area of the channel 43*b* between the arms, to stably secure the first receptacle body 43 (and hence the belly plate 30 that is attached thereto via screws 41) to the rigid tubular frame 12. Loosening the first bolts 44 loosens this grip and allows the belly plate 30 to be moved by the user upward or downward relative to the rigid tubular frame 12 into a desired position. The square-shaped heads 45 of the first bolts 44 may be tightened and loosened by a key (not shown) or other instrument controlled by the user.

It should be understood that the first bolts 44 and the first nuts 46 as well as other features of the first mounting members 40 may undertake other forms, such as quick-release pins, screws, clamps, tightening devices, components thereof, etc. Continuous height adjustability by which the first bolts 44 can secure the first receptacle bodies 43 at any location along the length of the end sections 16, 18 increases height adjustability selection. As an alternative embodiment, the end sections 16, 18 may be provided with one or more spaced holes that are alignable with fasteners such as a quick release pin or bolt for attaining interval height adjustability between die belly plate 30 and the rigid tubular frame 12.

The carrier 10 also includes second mounting members 50 that are virtually identical to the first mounting members 40. Because of the virtual identity between members 40 and 50, FIG. 7 includes reference numerals to corresponding parts of the second mounting member 50. Turning again to FIG. 7, the second mounting members 50 are mountable on the belly plate 30 in a manner similar to the first mounting members 40 described above. Each of the second mounting members 50 is mountable to the belly plate 30 by inserting a pair of screws 51 through corresponding ones of the second mounting apertures 38. The shafts of the screws 51 carry lock washers 52. The screw 51 shafts are received in threaded holes (not shown) in the rear surface of a second receptacle body (also referred to as a bracket) 53.

Again referring to FIG. 7, each of second mounting members 50 further includes a second bolt having a second square head 55, and a second nut 56. The second nut 56 is press-fitted into a rear arm of the second receptacle body (bracket 53). Referring to FIG. 7, the second receptacle body 53 may be provided with a shallow groove 53*a* for accommodating the rear end of the second nut 56, i.e., so that any rearwardly protruding portion of the rear end does not interfere with the flush interface between the rear surface of the second receptacle body 53 and the front surface of the belly plate 30. The second receptacle body 53 is mated with the second bolt by inserting the shaft of the second bolt through a front through hole (unnumbered) of a front arm of the second receptacle body 53. The front through hole is aligned with the second nut 56. A washer 58 may be carried on the second bolt adjacent to the head 55. The shaft of the second bolt is threadingly engaged with the second nut 56 and may be rotatably loosened and tightened using a key or other instrument that mates with head 55. Details of the screws and lock washers may be found in U.S. Pat. No. 7,671,261, which has been incorporated by reference in its entirety.

Each of the second receptacle bodies (brackets) 53 has a substantially vertically oriented open channel 53*b* that is configured and positioned to slidingly receive a longer leg of a respective J-rod 59. Tightening the second bolts flexes the second receptacle body 53 into a clamping position, reducing the cross-sectional area of the channel 53*b* between the front and rear arms of the second receptacle bracket 53. The J-rod 59 is thereby gripped and stably secured between the opposite arms of the second receptacle body 53 (and hence to the belly plate 30 that is attached to body 53 via screws 51). Loosening the second bolts 54 releases the J-rods 59 from clamping engagement, allowing the user to manually move the J-rods 59 upward or downward relative to the belly plate 30 into a desired playing position. The J-rods 59 are retained in the desired playing position by then tightening the second bolts 54 until the J-rods 59 are clamped between the opposite arms of the second receptacle bracket 53.

It should be understood that the second bolts 54 and second nuts 56 as well as other features of the second mounting members 50 may undertake other forms, such as quick-release pins, screws, clamps, tightening devices, components thereof, etc. Continuous height adjustability by which the J-rods 59 can be secured at any location along their length to the second mounting members 50 increases height adjustability selection. As an alternative embodiment, the J-rods 59 may be provided with one or more spaced holes that are alignable with fasteners such as a quick release pin or bolt for attaining interval height adjustability between the belly plate 30 and the J-rods 59.

The shorter legs of the J-rods 59 are adapted to engage one or more musical instruments, especially a percussion instrument such as a drum in manners well known in the art and any future manner yet to be discovered. The J-rods 59 may be of a solid, non-hollow construction or may have a tubular hollow or tilled construction, for example.

The second bolts (fasteners) may be the same or different than the first bolts (fasteners) described above. Alternatively, the second bolts (fasteners) and other parts of the second mounting members 50 may comprise, for example, clamps, quick-release pins, screws, tightening devices, components thereof, etc. The second bolts (fasteners) may allow for continuous or interval height adjustment of the J-rods 59 (and consequently the mounted musical instrument) relative to the belly plate 30.

It should be understood that the first mounting members 40 and the second mounting members 50 may possess different shapes and may be mounted on the belly plate 30 in alternative manners to those described above. The mounting members 40, 50 may, for example, be permanently welded or bonded to the belly plate 30. The first and second mounting members 40, 50 are depicted as discrete members with respect to one another. It should be understood that a pair or other plurality of the first and second receptacle bodies 43, 53 may be constructed or formed as a monolithic structure, e.g., a singular unitary body.

The mounting members 40, 50 can be made of light weight materials such as metals and/or composites to lessen the weight of the musical-instrument carrier 10, thereby improving comfort to the user and easing the weight load, especially over prolonged periods of use.

As best illustrated in FIG. 1, the first embodied carrier 10 includes a plate 80 extending between and connecting the first and second end sections 16, 18 of the rigid tubular frame 12. In the preferred embodiment, the rear of the plate 80 includes vertically oriented semi-cylindrical channels for receiving semi-cylindrical cross-sections of the first and second end sections, respectively. The brackets that are shaped, e.g., stamped, to possess semi-cylindrical arcuate portions are attachable to the back side of the plate 80 to extend across the aforementioned channels. The brackets are provided with holes which align with corresponding holes (not shown) in the rear of the plate 80. Fasteners (not shown) such as screws or the like are inserted through the holes and into the rear of the bracket and tightened the clamp to plate to the first and second end sections 16, 18 of the carrier 12.

The plate 80 is primarily intended as a signage area for advertisement and the like, e.g., to place the name of the carrier manufacturer or the name of the band or owner of the carrier 10. Secondarily, the plate 80 and brackets may contribute structural stability to the frame 12. Further, tabs (not shown) are welded to the frame 12 that may be used to support, for example, a bass drum via connecter 210 as will be described below with respect to the FIG. 19.

According to certain embodiments of the invention, die musical-instrument carrier 10 may further include a flexible belt 60 connected to the belly plate 30 and extending around the lower back region of the user for improving instrument stability and weight distribution. In the embodiment shown in FIG. 1, opposite belt ends 62, 64 of the flexible belt 60 pass through the belt-receiving slots 32, 34, respectively, at the opposite side edges of the belly plate 30. The first belt end 62 is removably connected to the belly plate 30 at slot 32 using a suitable fastener, e.g., Velcro. The first belt end 62 of the belt 60 alternatively may be fixedly and permanently connected to the belly plate 30 at slot 32, for example, by looping the first belt end 62 through the slot 32 and sewing die belt end 62 to itself. The second belt end 64 is slidable through the slot 34 by the user to tighten and loosen the belt 60 about the lower back region of the user. The second belt end 64 is provided with a fastener for retaining the belt 60 at its desired tightness. Buckles and Velcro are examples of adjustable fasteners for retaining the belt tightness. Alternatively, both the first and second ends of the belt 60 may be adjustable relative to their respective slots 32, 34.

Figure 3:
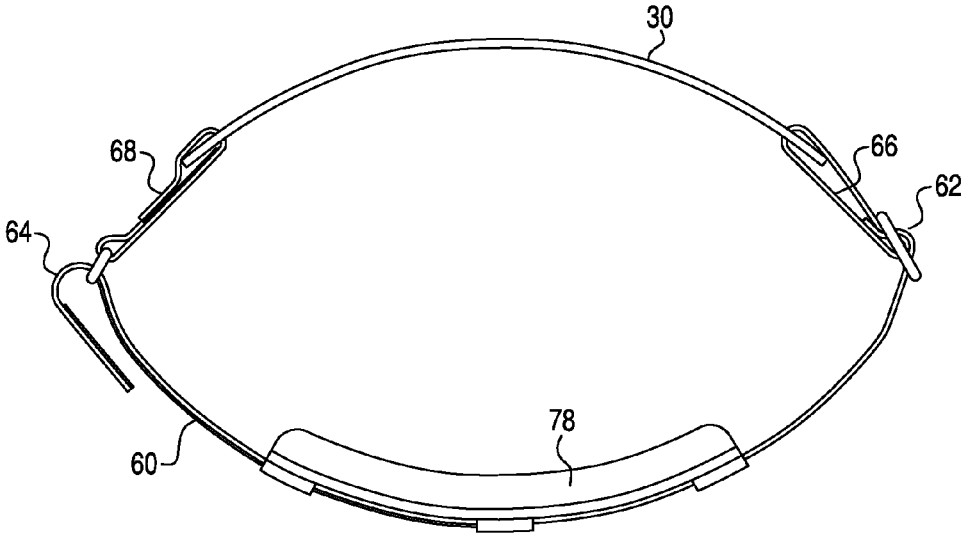
FIG. 3 is an overhead view of a belly plate and flexible belt of the body-supportable musical-instrument carrier of FIGS. 1 and 2, modified to including linking members to connected the flexible belt to the belly plate.

In a slightly modified embodiment shown in FIG. 3, linking members 66 and 68 connect the first and second ends 62, 64 of the flexible belt 60 to the slots 32, 34, respectively.

Figure 15:
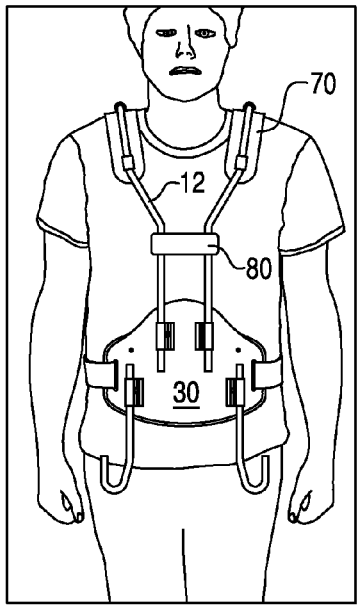
FIG. 15 is a front view of a body-supportable musical-instrument carrier according to the present invention worn by a musical instrument player or user.
Figure 16:
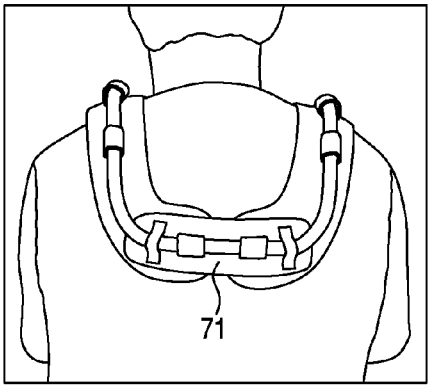
FIG. 16 is a rear view of the body-supportable musical-instrument carrier of FIG. 15 shown across the upper back of the player/user.

The musical-instrument carrier 10 may further include cushions for enhancing comfort to the user. In the illustrated embodiment, shoulder cushions 70 underlie the shoulder support and back areas of the substantially U-shaped intermediate section 14 of the rigid tubular frame 12. A single cushion or multiple cushions may be used to protect the shoulder and back areas of the user. Further, a plate (see 71 in FIG. 16) may be provided along the back of the frame 12 to fixedly secure the cushion(s) relative to the frame 12. As best shown in FIGS. 1, 15 and 16, the shoulder cushion(s) 70 may be shaped or arranged to conform to the contour of the rigid tubular frame 12. The shoulder cushions 70 and other cushions described herein may include foam-filled pads 72. The shoulder cushions 70 are removably attached to the rigid tubular frame 12 using, for example, Velcro straps 74 or other attachments for allowing quick removal of the shoulder cushions 70 for cleaning and replacement purposes. The Velcro straps 74 are joined to the shoulder cushions at plate (e.g., plastic) using any suitable fastening or bonding means. Although not shown, similar cushions may underlie and be attached to the first and second end section 16, 18 of the rigid tubular frame 12 and elsewhere.

Additionally, an abdominal cushion 76 is shown secured to the rear surface of the belly plate 30 in FIG. 2. As best shown in FIG. 3, a back cushion 78 is secured to the portion of the belt 60 that comes into contact with the lower back area of the user. The abdominal cushion 76 and back cushion 78 may be detachable from the belly plate 30 and the belt 60, respectively, for cleaning and replacement purposes.

Figure 8:
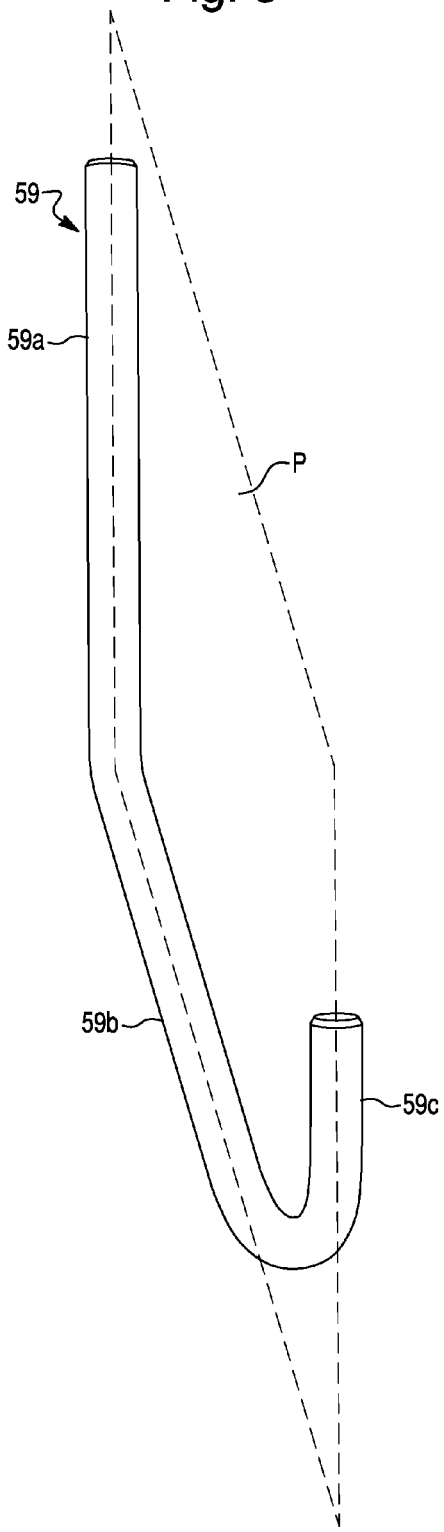
FIG. 8 is a front, left-side perspective view of a conventional J-rod member.
Figure 9:
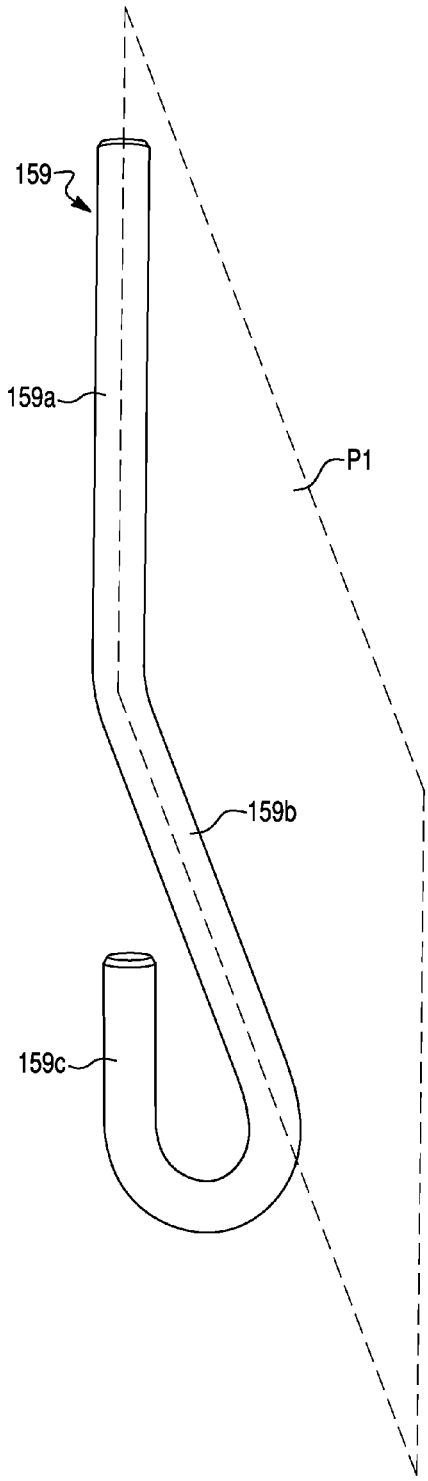
FIG. 9 is a front, left-side perspective view of the J-rod member according to the present invention.

In accordance with the invention, a belly plate 30 is fastened by first mounting members 40 mountable on the belly plate 30 and engageable with the rigid frame 12 for securing the belly plate 30 to the rigid frame 12. Second mounting members 50 are mountable on the belly plate 30 and engageable with a musical instrument via J-rods 59 for securing the musical instrument to the body-supportable musical-instrument carrier. The second mounting members 50 comprise at least one rod 59 having a first end portion 59*a* mounted to the belly plate 30, an intermediate portion 59*b*, and a second end portion 59*c* opposite the first end portion 59*a* of the rod 59, FIG. 8 illustrates the conventional J-rod structure, whereby the first end portion 59*a*, the intermediate portion 59*b*, and the second end portion 59*c* are aligned in the same plane 'P' as shown in FIG. 8. In accordance with the present invention, a unique J-rod structure 159 is provided whereby the first end portion 159*a* and intermediate portion 159*b* both extend in a single plane ('P1'): however, the second end portion 159*c* lies outside of plane 'P1' to thereby increase a spacing for the user's legs without changing a distance of the second end portion from the first end portion.

Figure 10:
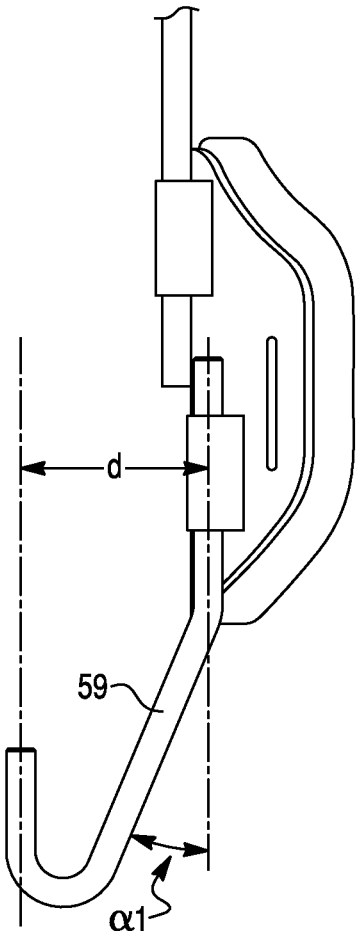
FIG. 10 is a side view of the conventional J-rod member mounted to a conventional belly plate.
Figure 11:
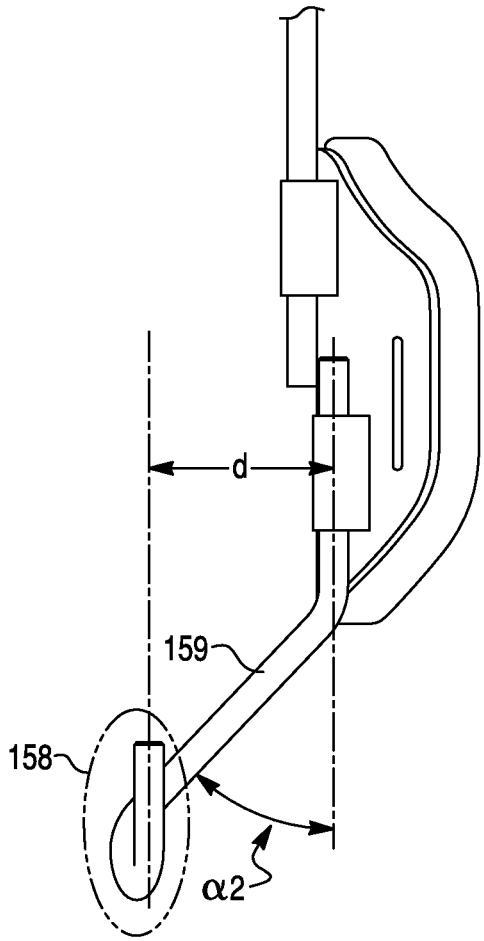
FIG. 11 is a side view of the J-rod member according to the present invention mounted to a conventional belly plate.
Figure 12:
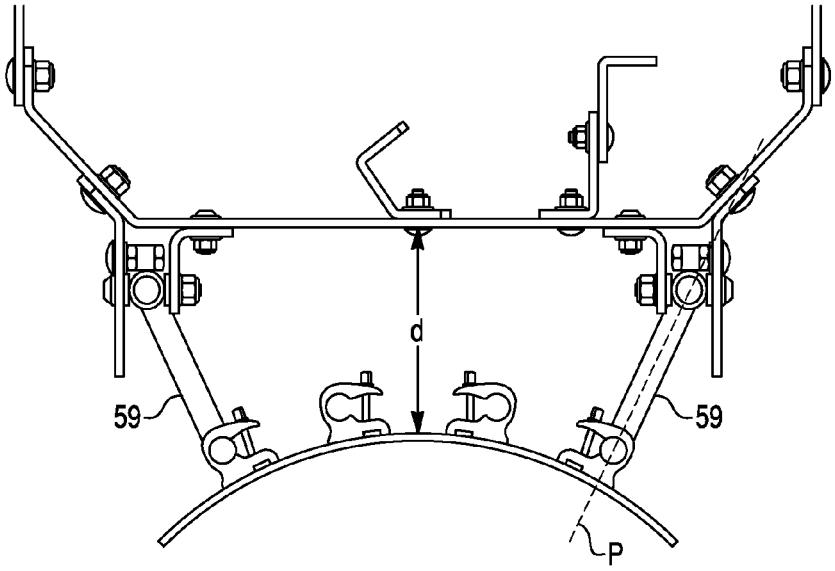
FIG. 12 is a top view of the conventional J-rod member mounted to a conventional belly plate.

As shown more specifically in FIGS. 10 and 11, the conventional J-rod 59 shown in FIG. 10 extends away from the user at an angle $\alpha 1$ which is known in the art. The unique J-rod 159 of the present invention utilizes a compound joint shown at 158 to increase the angle to angle shown at $\alpha 2$. This J-rod arrangement increases spacing for the user's legs without changing a distance of the second end portion 159*c* from the first end portion 159*a* when compared to the convention J-rod assembly of FIG. 10. When comparing FIGS. 10 and 11, the distance 'd' does not change even though the angle $\alpha 2$ is greater than angle $\alpha 1$. This benefit of the present invention is again shown in FIGS. 12 and 13, whereby the distance 'd' is the same in the convention arrangement of FIG. 12 when compared to the novel arrangement of this invention shown in FIG. 13. FIG. 12 again illustrates the fact that the conventional J-rod 59 has a body that lies entirely within a single plane 'P', whereas the J-rod 159 according to the present invention comprises a compound joint 158 so that the end 159*c* lies outside the plane 'P' defined by the first end portion 159*a* and the intermediate portion 159*b*. See FIG. 13.

Figure 13A:
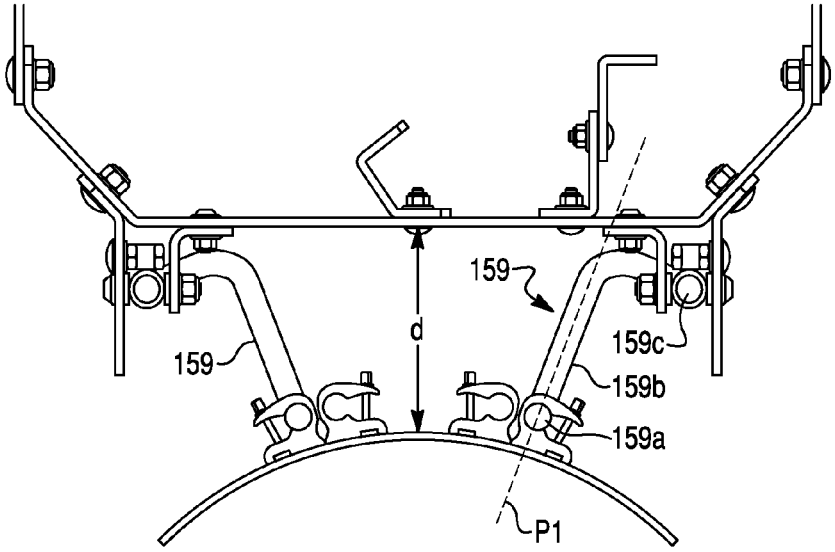
FIG. 13A-13C are views of the J-rod member according to the present invention mounted to a conventional belly plate with FIG. 13A showing the J-rod members used with a tenor drum assembly and FIGS. 13B and 13C showing the J-rod members used with a snare drum assembly.
Figure 13B:
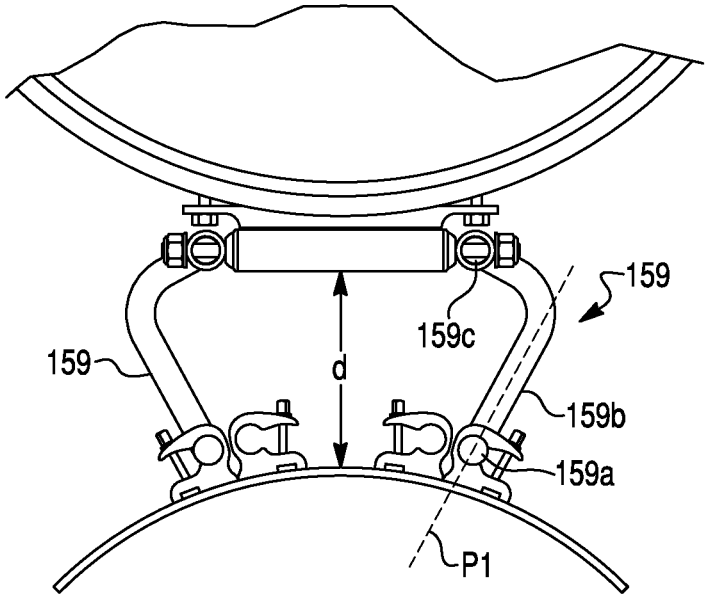
Figure 13C:
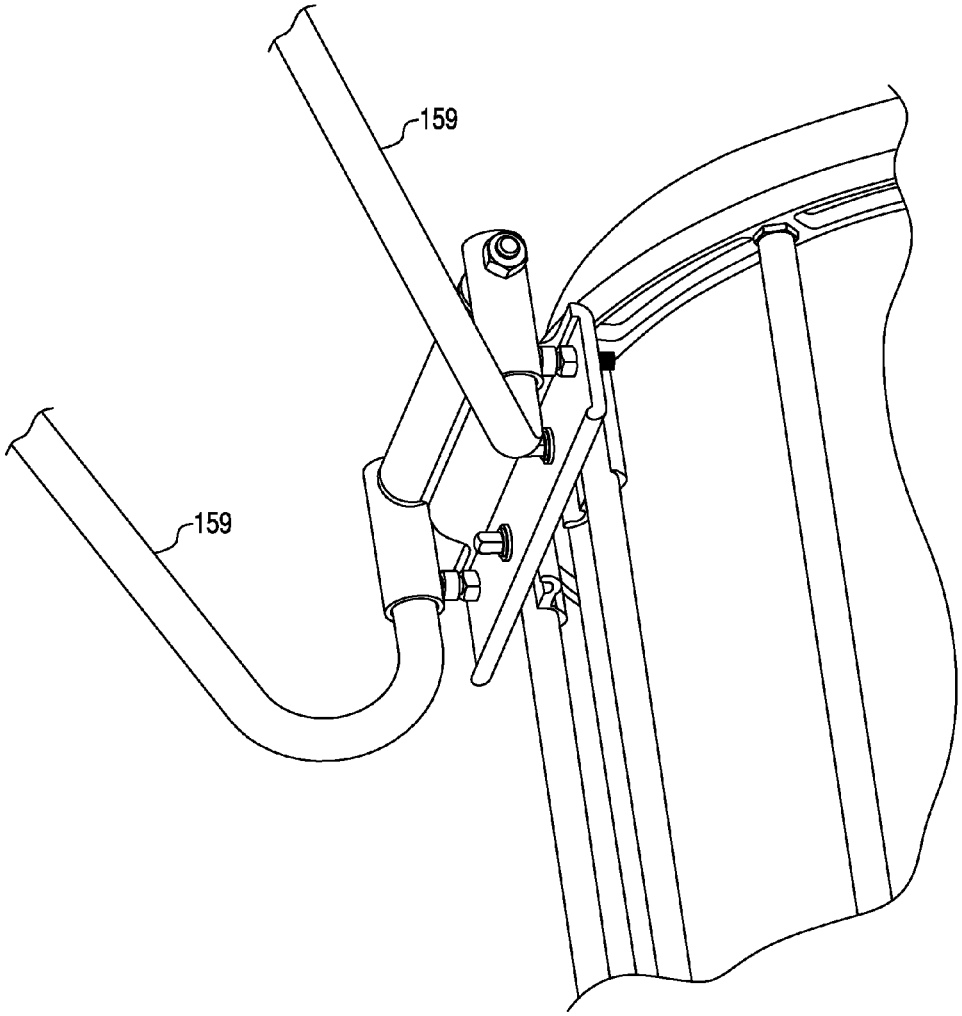

As illustrated in FIG. 13A, the second mounting members 50 comprise a pair of rods 159 having a first end portion 159*a* mounted to the belly plate 30 and a second end portion 159*c* defined by a compound bend 158 such that the second end portions 159*c* of each of the rods 159 have a lowest vertical end section extending away from one another when used to support a tenor drum. As illustrated in FIG. 13B, the second mounting members 50 comprise a pair of rods 159 having a first end portion 159*a* mounted to the belly plate 30 and a second end portion 159*c* defined by the same compound bend 158 such that the second end portions 159*c* of each of the rods 159 have a lowest vertical end section extending toward one another when used to support a snare drum. See FIG. 13C. Thus, by simply reversing the J-rod 159, the J-rod can accommodate both tenor and snare applications. As such, for each of the pair of rods 159, the rod 159 includes a transition 158 from the intermediate portion 159*b* to the second end portion 159*c*, the transitions are defined by transverse extensions (e.g., compound joints 158) extending toward or away from each other.

Figure 14:
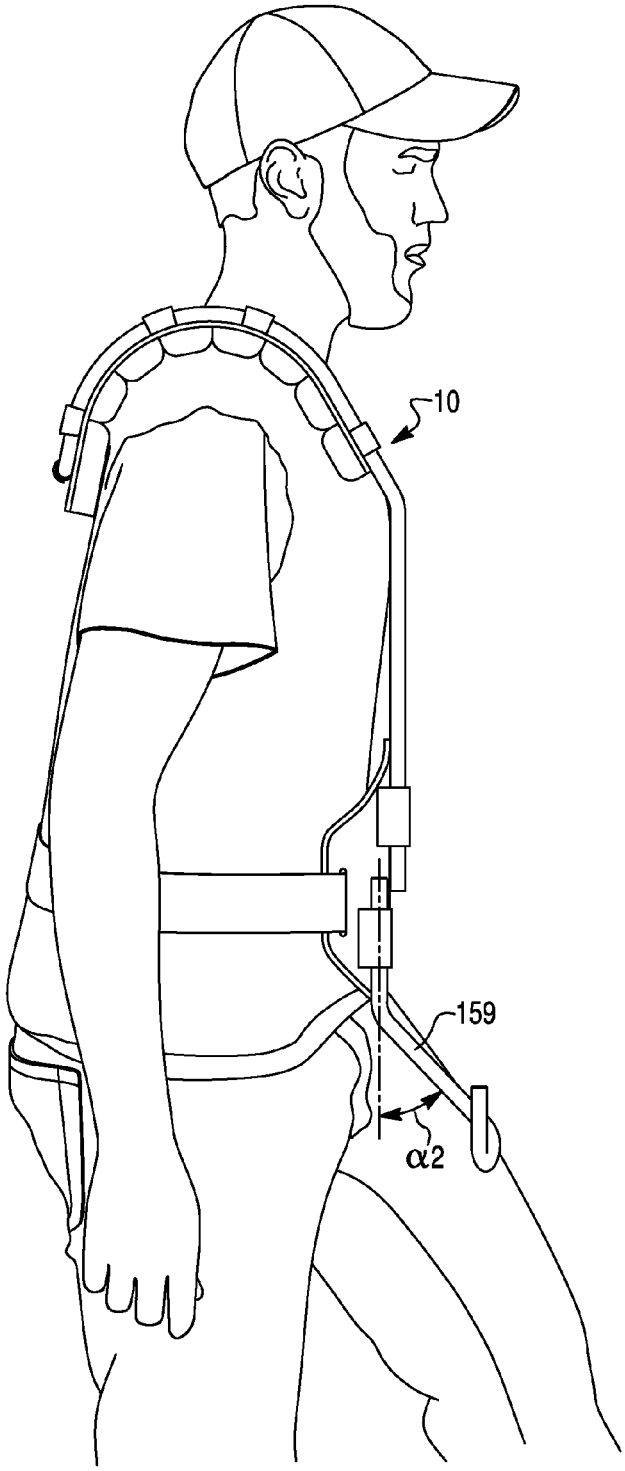
FIG. 14 is a side view of a body-supportable musical-instrument carrier according to the present invention worn by a musical instrument player or user.

FIG. 14 shows the novel compound J-rod 159 of the present invention in relation to the body of a user. As seen in FIG. 14, when compared to FIGS. 10 and 11, the improved J-rod 159 increases the angle between the user's legs and the J-rod 159 to increase a range of motion for the user's legs by increasing the space between the user's legs and the J-rod 159, without increasing the distance 'd' of the musical instrument(s), such as snare or torn drums from the carrier 10.

Application of the carrier 10 to a user for supporting a musical instrument will now be described with reference to FIGS. 15-17, which depict an embodiment substantially identical to the first embodiment described above. To apply the carrier 10 to a user, the rigid tubular frame 12 is slipped over the head of the user to rest the substantially U-shaped intermediate section 14 on the shoulder regions and across the upper back region of the user, as best shown in FIGS. 15 and 16. The first and second end sections 16, 18 extend substantially parallel to one another in front of the front torso region of the user when the frame 12 is properly positioned. The height-adjustable belly plate 30 is secured to the first and second end sections 16, 18 of the rigid tubular frame 12 as follows. The first mounting members 40 are engaged to the first mounting apertures 36 of the belly plate 30 using screws 41 and lock washers 42. The opposite ends of the frame 12 are slid into the respective first receptacle bodies 43 of the first mounting members 40. The belly plate 30 is raised to its desired height along the length of the first and second end sections 16, 18 of the frame 12, and the first bolts (fasteners) 44 are tightened or otherwise actuated to secure the belly plate 30 to rigid tubular frame 12 at the desired height. It should be understood that attachment of the belly plate 30 to the mounts 40 and 50 and attachment of the belly plate 30 to die rigid tubular frame 12 may be performed before or after the frame 12 is placed on the user.

Figure 17:
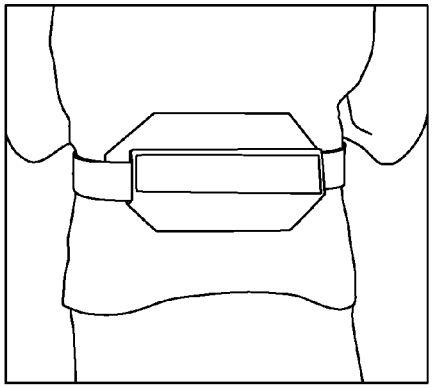
FIG. 17 is a rear view of the body-supportable musical-instrument carrier of FIG. 15 shown across the lower back of the player/user.

As best shown in FIGS. 2, 3 and 17, the flexible belt 60 is wrapped around the lower back region of the user. The adjustable second belt end 64 is slid through the slot 34 by the user to tighten and loosen the belt 60. A fastener, such as a buckle or Velcro, at the first belt end 62 retains the belt 60 at its selected tightness.

The second mounting member 50 are engaged to a selected pair of the second mounting apertures 38 of the belly plate 30 using screws 51 and lock washers 52. The longer legs of the J-rods 159 are slid into their respective second receptacle bodies 53. The J-rods 159 are placed at their desired height and the second bolts (fasteners) 54 are tightened or otherwise actuated to secure the J-rods 159 to the second receptacle bodies 53, and consequently the belly plate 30. One or more musical instruments, e.g., a dram with a horizontal playing surface, is/are mounted on the J-rods 159 in a secure and stable manner.

Height adjustment of the musical instrument(s) may be accomplished using one or more of the adjustability features described above. Height adjustment is implemented by any one or more of the following: (a) slidingly positioning and clamping the end sections 16, 18 of the rigid frame 12 in the first mounting members 40 to alter the height of the belly plate 30 relative to the frame 12, (b) selecting from the apertures 36, 38 in which to mount the first and second mounting members 40, 50, respectively, and/or (c) slidingly locating and clamping the J-rods 159 at a desired height in the second receptacle bodies 53 of the second mounting members 50. The multiple height adjustment connections of the musical-instrument carrier 10 increase the overall height adjustability range of the musical instrument(s) on the carrier 10.

Figure 18:
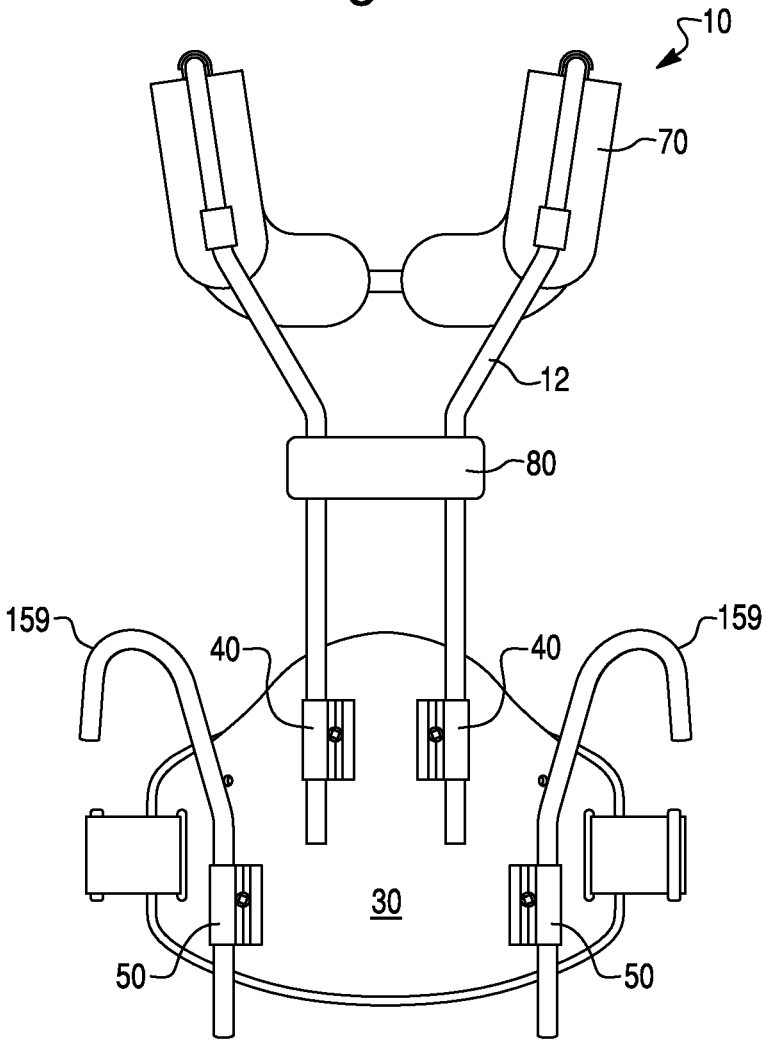
FIG. 18 is a front elevational view of a body-supportable musical-instrument carrier according to another embodiment of the invention used with a bass drum.
Figure 19:
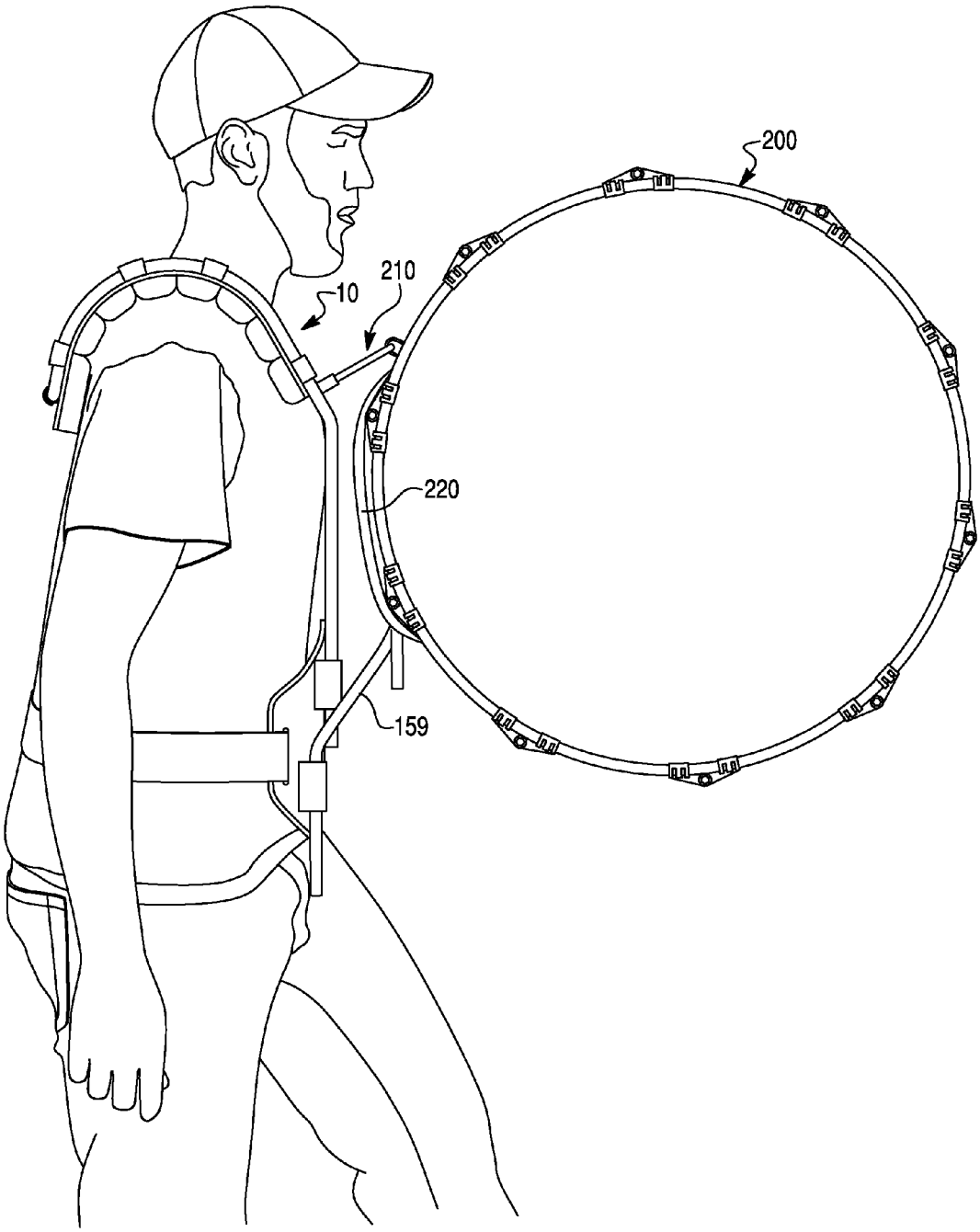
FIG. 19 is a side view of a body-supportable musical-instrument carrier according to the present invention worn by a musical instrument player or user to carry a bass drum.

FIG. 18 shows the novel compound J-rod 159 of the present invention mounted to the carrier 10 in an inverted position when compared to FIG. 1. As with the description with regard to FIG. 1, the J-rod 159 is mounted to the mounting members 50 in an inverted position to provide support for a bass drum. FIG. 19 shows the novel compound J-rod 159 of the present invention in relation to the body of a user when the user is supporting a bass drum 200. As shown, the bass drum 200 is mounted to the carrier 10 via a conventional mechanical connector 210, for example, through a hook, link, or other mechanical connecter that fastener to the side of a bass drum. In the embodiment of FIG. 19, the bass drum 200 simply rests against the novel J-rod members 159. Typically, a protective sheathing is applied to the J-rod 159 to protect the drum from damage such as scratches. Alternatively, a protective member 220 may be placed between the J-rod 159 and the side wall of the bass drum 200 to protect the bass drum from any damage such as scratches.

Advantageously, the invention as embodied in certain exemplary embodiments described herein provides a J-rod assembly that improves the usability of the carrier by increasing leg room of the user without detracting from the traditional aspects of this type carrier. Additionally, the J-rods 159 of the present invention have a broader contact area against the drum for better stability compared to traditional support rods. Traditional support rods are capped with a rubber tip that often fail and expose the metal ends of the rods which can damage the drum. The new J-rods according to the present invention are rounded and sheathed to better protect the drum.

Further, the invention provides a carrier that is easy to use and quick to assemble. The relatively small number of components makes the carrier inexpensive to produce and reduces the weight penalty during use, particularly in the hollow construction embodiments. These advantages allow the user to preserve his or her energy and march/play for longer periods of time. As embodied in certain exemplary embodiments described herein, the carrier provides multiple points of instrument height adjustment for increasing the overall versatility of the carrier, making it suitable for tall and short users alike. The exemplary carrier stably retains the mounted musical instrument(s) in a fixed position while freeing up both hands of the user to play the musical instrument(s). The exemplary carrier is constructed to permit the user to put on, remove, and fit the exemplary carrier with minimal assistance and difficulty.

The foregoing detailed description of the certain exemplary embodiments of the invention has been provided for the purpose of explaining the principles of the invention and its practical application, thereby enabling others skilled in the art to understand the invention for various embodiments and with various modifications as are suited to the particular use contemplated. This description is not intended to be exhaustive or to limit the invention to the precise embodiments disclosed. Modifications and equivalents will be apparent to practitioners skilled in this art and are encompassed within the spirit and scope of the appended claims and their appropriate equivalents.

What is claimed is:

1. A J-rod member for a musical instrument carrier, said J-rod member comprising:

a first end portion adapted to be mounted to a belly plate, an intermediate portion extending from the first end portion, said first end portion and said intermediate portion defining a bent bar that lies in a single plane;

a second end portion extending from the intermediate portion opposite said first end portion of said J-rod member, said second end portion defining a u-shaped member, wherein the second end portion extends away from said single plane defined by said bent bar.

2. The J-rod member according to claim 1, wherein said first end portion, said intermediate portion and said second end portion are integrally formed as a unitary body.

3. The J-rod member according to claim 1, wherein said second end portion defines a compound joint forming said u-shaped member.

4. A combination belly plate and pair of J-rods, said combination defining a support for a musical instrument interconnected to a carrier to be worn by a user, said combination comprising:

first mounting members mountable on the belly plate and engageable with a rigid frame of said carrier for securing the belly plate to the rigid frame; and second mounting members mountable on the belly plate and engageable with a musical instrument for securing the musical instrument to the carrier, wherein said second mounting members comprise said pair of J-rods, each J-rod having a first end portion mounted to the belly plate, an intermediate portion, and a second end portion opposite said first end portion of a respective J-rod, and wherein a transition between said first end portions and said second end portions define a compound bend, and wherein the first end portion and intermediate portion of said each J-rod both extend in a single plane and said second end portion of said each J-rod extends away from said single plane to thereby increase a spacing for the user's legs.

5. The combination according to claim 4, wherein, when the compound bend is mounted to the second mounting members to be disposed below the rigid frame, said second end portions of each of said J-rods have a lowest vertical end section extending away from one another when supporting a tenor drum.

6. The combination according to claim 4, wherein, when the compound bend is mounted to the second mounting members to be disposed below the rigid frame, said second end portions of each of said J-rods have a lowest vertical end section extending toward one another when supporting a snare drum.

7. The combination according to claim 4, wherein said J-rods are tubular in shape.

8. A body-supportable musical-instrument carrier, comprising:

a rigid frame substantially conforming to shoulder regions of a user for resting on the shoulder regions of the user in use, the rigid frame further resting in front of a front torso region of the user in use;

a belly plate;

first mounting members mountable on the belly plate and engageable with the rigid frame for securing the belly plate to the rigid frame; and at least one second mounting member mountable on the belly plate and engageable with a musical instrument for securing the musical instrument to the body-supportable musical-instrument carrier, wherein said at least one second mounting member comprises at least one rod having a first end portion mounted to the belly plate, an intermediate portion, and a second end portion opposite said first end portion of said at least one rod, and wherein the first end portion and intermediate portion both extend in a single plane and said second end portion extends away from said single plane.

9. The body-supportable musical-instrument carrier according to claim 8, wherein said at least one second mounting members increase spacing for the user's legs without changing a distance of a second end portion from a first end portion when supporting at least one drum.

10. The body-supportable musical-instrument carrier according to claim 8, wherein said at least one second mounting member is adapted to be inverted with respect to said belly plate to support a bass drum on said carrier.

11. The body-supportable musical-instrument carrier according to claim 8, wherein said at least one second mounting member further comprises a second rod having a shape substantially identical to said at least one rod.

12. The body-supportable musical-instrument carrier according to claim 8, wherein said at least one second mounting member comprises a pair of rods having a first end portion mounted to said belly plate and a second end portion defined by a compound bend such that said second end portions of each of said rods have a lowest vertical end section extending away from one another.

13. The body-supportable musical-instrument carrier according to claim 12, wherein, for each of said pair of rods, said rod includes a transition from said intermediate portion to said second end portion, said transition defined by a transverse extension extending away from each other.

14. The body-supportable musical-instrument carrier according to claim 12, wherein said pair of rods each are formed with said first end portion extending along said belly plate, with a transitional portion extending at an angle with respect to a first end portion, and with said compound bend at a respective second end portion.

15. The body-supportable musical-instrument carrier according to claim 8, wherein said first end portion, said intermediate portion and said second end portion are integrally formed as a unitary body.

16. The body-supportable musical-instrument carrier according to claim 8, wherein said at least one rod is formed as a tubular member.

* * * * *